United States Patent [19]

Johnson et al.

[11] Patent Number: 4,564,396

[45] Date of Patent: Jan. 14, 1986

[54] FORMATION OF AMORPHOUS MATERIALS

[75] Inventors: William L. Johnson, Pasadena, Calif.; Ricardo B. Schwarz, Westmont, Ill.

[73] Assignee: California Institute of Technology, Pasadena, Calif.

[21] Appl. No.: 462,441

[22] Filed: Jan. 31, 1983

[51] Int. Cl.[4] ..... C23C 8/00

[52] U.S. Cl. ..... 148/4; 148/1; 148/127; 148/403; 420/590; 427/383.9

[58] Field of Search ..... 148/1, 4, 127, 31, 403, 148/421, 425, 426, 432, 430; 420/590; 427/383.9; 428/606

[56] References Cited

U.S. PATENT DOCUMENTS

| | | | |
|---|---|---|---|
| 1,916,410 | 7/1933 | Brace | 420/590 |
| 2,291,865 | 8/1942 | Bernstorff | 420/590 |
| 3,782,926 | 1/1974 | Kirkpatrick et al. | 420/590 |
| 4,060,430 | 11/1977 | Kauesh | 148/421 |
| 4,093,453 | 6/1978 | Makino et al. | 420/590 |
| 4,144,058 | 3/1979 | Chen et al. | 148/403 |
| 4,250,229 | 2/1981 | Kear et al. | 428/606 |
| 4,297,135 | 10/1981 | Giessen et al. | 148/425 |
| 4,362,582 | 12/1982 | Danko | 148/127 |

OTHER PUBLICATIONS

Journal Vacuum Science and Technology, vol. 15, No. 5, Sep. 1978, "Metastable Alloy Formation" pp. 1636–1643.

A dictionary of Metallurgy, A. D. Merriman 1958, p. 187.

*Primary Examiner*—John P. Sheehan

*Attorney, Agent, or Firm*—Marvin E. Jacobs

[57] ABSTRACT

Metastable amorphous or fine crystalline materials are formed by solid state reactions by diffusion of a metallic component into a solid compound or by diffusion of a gas into an intermetallic compound. The invention can be practiced on layers of metals deposited on an amorphous substrate or by intermixing powders with nucleating seed granules. All that is required is that the diffusion of the first component into the second component be much faster than the self-diffusion of the first component. The method is practiced at a temperature below the temperature at which the amorphous phase transforms into one or more crystalline phases and near or below the temperature at which the ratio of the rate of diffusion of the first component to the rate of self-diffusion is at least $10^4$. This anomalous diffusion criteria is found in many binary, tertiary and higher ordered systems of alloys and appears to be found in all alloy systems that form amorphous materials by rapid quenching. The method of the invention can totally convert much larger dimensional materials to amorphous materials in practical periods of several hours or less.

14 Claims, 6 Drawing Figures

FORMATION OF AMORPHOUS MATERIALS

ORIGIN OF THE INVENTION

The invention described herein was made in performance of work under a Department of Energy contract.

TECHNICAL FIELD

The present invention relates to the formation of amorphous and fine crystalline solid materials and, more particularly, to a completely new method of synthesizing such materials based on solid state reactions which occur by diffusion of a metallic component into another or by diffusion of a gas into an intermetallic compound.

BACKGROUND ART

Recent industrial tests of amorphous alloys under realistic working environments have indicated that the wear and corrosive resistances of this new category of alloys are at least one order of magnitude higher than that of conventional alloys currently in use. Other amorphous metal compounds are of interest as superconductors at low temperature and as magnetically soft alloys, etc.

Metallic glasses or, equivalently, amorphous metallic alloys can be formed by rapid cooling of liquid metals, or deposition of metallic vapors at rates sufficient to bypass crystallization. For the formation of a metallic glass, cooling rates in the range $10^4$–$10^{12}$ K/s are required to suppress nucleation and growth of more stable crystalline phases in undercooled alloy melts. These facts lead to severe restrictions in the synthesis of glassy metals. For example, simple heat transfer considerations require at least one of the specimen dimensions to be rather small, typically $10\mu$–$100\mu$.

The earliest glassy alloys were manufactured by the splat cooling, gun technique, in which a small quantity of molten alloy was expelled by a shock wave onto a stationary or moving quenching substrate. The shock wave rapidly fragments the melt into tiny droplets which cool to form flake-like products. All subsequent methods have analogous counterparts to splat cooling in that they involve quenching of a high-temperature phase such as a liquid or a vapor phase. Up to the present invention, glassy metal alloys have been made by rapid solidification. Rapid solidification has been achieved by imposing a high undercooling to a melt prior to solidification or by imposing a high velocity of advance to the melt-solid interface during continuous solidification. The undercooling method is limited by the fact that the large supercooling required can only be achieved in the absence of nucleating agents which is difficult to achieve with large melts and is especially hard to achieve for the more reactive metals and alloys. The high-velocity-of-advance technique is limited by heat flow constraints which set in at a cross-section dimension of a few mm.

The production methods all require a primary stage of generating and quenching the melt and, if necessary, a secondary stage of consolidating the product into a useful form. The primary stage requires rapidly bringing a melt of small cross-section into good contact with an effective heat sink. Several methods have been developed which can be classified as spray methods, chill methods and weld methods.

The spray techniques are preferable to the other methods since the cooling rate is rapid before, during and after solidification, increasing the likelihood of retaining the glassy microstructure of the quenched, amorphous material. However, the spray methods are inefficient from an energy standpoint, provide very small sized product which must be further processed by consolidation or dispersed in a matrix resin to form a useful composite.

DISCLOSURE OF INVENTION

A new method of synthesizing metastable metallic amorphous, crystalline or microcrystalline materials has been developed in accordance with this invention. The inventive method does not rely on the rapid solidification of molten materials and is not limited to extremely small dimensions since it is not necessary in the method of the invention to quickly quench a melt. In fact, the method can be implemented under isothermal conditions. The method of the invention is simple to practice and provides high yield of amorphous materials in a convenient and cost effective manner. The method can be practiced on materials having much larger final cross-sections and is much more efficient in the utilization of energy since it does not require heating the starting materials above their melting point. The starting materials can be in the form of thin layers, strips, powders, etc.

The method of the invention has only two requirements.

The first requirement in the method of the invention is that the amorphous phase to be formed have a lower free energy than the sum of the free energies of the starting constituent components in their initial configuration. This requirement is of a thermodynamic nature and is equivalent to stating that a thermodynamic driving force exists for the reaction. The second requirement in the method of the invention is that the diffusion of one component into another component occur at a sufficiently high rate as to grow an amorphous phase material from these two components in practical time scales and at temperatures that are too low for either (a) the nucleation of a crystalline phase of the constituent components or (b) the growth of an already existing crystalline nucleus using material from the constituent components, or (c) both of the above. This second requirement is of a kinetic nature and amounts to stating that the reaction to form the amorphous phase be the only kinetically allowed reaction.

The two requirements stated above are found in many binary, tertiary, or higher order systems of alloys. In particular, the second requirement of anomalous diffusion is found in nearly all alloy systems that form amorphous materials by the method of rapid quenching.

The method of the invention can totally convert much larger dimensional crystalline materials to amorphous materials in practical periods of time.

These and many other features and attendant advantages of the present invention will become apparent as the invention becomes better understood by reference to the following detailed description when considered in conjunction with the accompanying drawings.

BRIEF DESCRIPTION OF THE DRAWINGS

FIG. 3(*b*) is a schematic representation of the growth of amorphous material from a multilayer structure without the use of intentionally introduced amorphous layers.

DETAILED DESCRIPTION OF THE INVENTION

Figure 1:
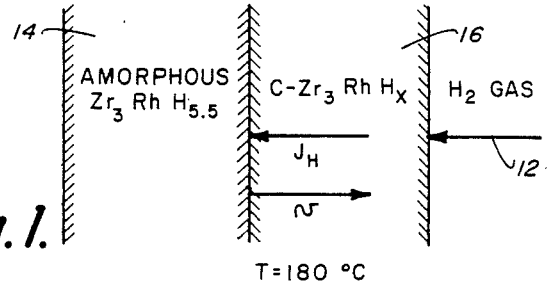
FIG. 1 is a schematic view of the growth of an amorphous hydride at low temperature by the method of the invention.

A mixture of two elements A and B can exist in a number of possible configurations for which the free energy is lower than the sum of the free energies of the unmixed elements. The lowest free energy state, the thermodynamic equilibrium state, is invariably observed to consist of a single phase crystalline material or a combination of two crystalline phases. Even though the thermodynamic equilibrium state is the state that results in the lowest free energy of the mixture, there are other possible metastable states which the system may adopt where the free energy of the system is lower than that of the unmixed elements, but higher than that of the thermodynamic equilibrium state. For specific reasons it is of interest to force the elements A and B to react and form one of such metastable states. The essence of this invention is the provision of a method that can be used to form metastable amorphous or metastable crystalline states through solid state reactions under isothermal conditions.

Even though the above discussion refers to a binary system of elements A and B, the method can be equally applied to ternary and higher-order systems. The examples described in the following pages involve both binary and ternary systems.

Reactions of the type outlined above are subject to kinetic constraints. These constraints include diffusion rates, nucleation rates of new phases, and growth rates of new phases once formed. Each of these rates is determined by thermally activated processes, the main characteristic of which is a strong (exponential) temperature dependence. Therefore each of these processes can be, from a practical point of view, completely suppressed by sufficiently lowering of the temperature.

The concept underlying the invention is that by a proper choice of materials, sample configuration, and reaction temperature, one can selectively control which of the possible reactions is kinetically allowed. In particular, it has been found that for a large class of materials, the so-called anomalous fast diffusion systems (see Table 1), a temperature range exists in which nucleation and growth of thermodynamically stable crystalline phases occurs at a substantially lower rate than the nucleation and (or) growth of thermodynamically metastable amorphous or metastable crystalline phases.

An empirical criteria has been established which allows one to identify those systems (binary, ternary, or of higher order) that are most favorable for reacting into metastable phases. This criteria has been further developed to enable one to identify the temperature regime suitable for performing this reaction.

For the case of reacting two constituents A and B to form a metastable phase, the criteria to be followed are: (a) At the reaction temperature one of the components, say B, must diffuse in the other, component A, through a distance comparable to the dimensions of the starting constituents in practical time periods. This establishes a lower bound $T_L$ for the reaction temperature. (b) The reaction temperature must be lower than the crystallization temperature at which the amorphous phase to be formed is known to transform into one or more of the more stable crystalline phases. This establishes an upper bound $T_X$ for the reaction temperature. Only when $T_X$ is significantly greater than $T_L$ does a workable temperature regime exist. In practice it has been found that these criteria can be satisfied in systems where the diffusion constant of B in A exceeds the self diffusion constant of A in A by 4 or more orders of magnitude There are two general classification of compounds in which formation of amorphous compounds is observed. Compounds AB in which A is an early transition metal (ETM) and B is a late transition metal (LTM) and is the fast diffusion species. ETM can be selected from Groups IIIB, IVB or VB of the Periodic Table of Elements and LTM can be selected from Groups VIIB, VIII or IB. Representative AB compounds are YCu, YCo, ZrCu, ZrNi, ZrCo, TiNi, NbNi and AuLa.

Amorphous materials can also be formed with compounds of transition metals selected from Groups IB, VB, VIB, VIIB or VIII with a metalloid selected from Groups IIIA, VIA or VA. Representative compounds are FeB, NiB, CoB, FeP, NiP and PdSi.

Based on the criteria presented above, a survey of the literature on diffusion and amorphous state formation has been conducted and metastable forming compositions of the formula $A_{1-x}B_x$ which satisfy the criteria are presented in the following table:

TABLE 1

| Host Metal A | Fast Diffusing Metal B in Host A | Glass Forming Alloy $A_{1-x_o}B_{x_o}$ |
|---|---|---|
| Zr (zirconium) | Cu (copper) | $0.25 < x_o < 0.65$ |
| | Ni (nickel) | $0.30 < x_o < 0.60$ |
| | Co (cobalt) | $0.25 < x_o < 0.50$ |
| | Fe (iron) | $0.20 < x_o < 0.40$ |
| Ti (titanium) | Cu | $0.30 < x_o < 0.60$ |
| | Ni | $0.30 < x_o < 0.50$ |
| | Co | $0.25 < x_o < 0.40$ |
| | Fe | $0.25 < x_o < 0.40$ |
| La (lanthanum) | Au (gold) | $0.20 < x_o < 0.35$ |
| | Ag (silver) | $0.20 < x_o < 0.35$ |
| | Cu | $0.25 < x_o < 0.35$ |
| | Ni | $0.25 < x_o < 0.40$ |
| Y (Yittrium) | Cu | $0.25 < x_o < 0.40$ |
| | Ni | $0.25 < x_o < 0.40$ |
| | Co | $0.25 < x_o < 0.40$ |
| | Fe | $0.25 < x_o < 0.40$ |
| Fe (Iron) | B (boron) | $0.10 < x_o < 0.30$ |
| | C (carbon) | — |
| | P (phosphorous) | $0.15 < x_o < 0.25$ |
| Ni (nickel) | B | $0.15 < x_o < 0.40$ |
| | C | — |
| | P | $0.15 < x_o < 0.30$ |
| Co (cobalt) | B | $0.15 < x_o < 0.30$ |
| | C | — |
| | P | $0.15 < x_o < 0.30$ |

The invention and the criteria discussed above are best illustrated by several specific examples which serve to illustrate the wide applicability of the method of the invention.

EXAMPLE 1

Reaction of hydrogen gas with an intermetallic compound to form an amorphous metallic hydride. Samples of $Zr_3Rh$ in the form of ingots were prepared by melting the constituents together in a levitation furnace. The ingots were checked for homogeneity and then broken into ~100 mg pieces. These pieces were used to produce splat quenched foils using the piston and anvil technique. Whole ingots were used to produce ribbons of material by the melt spinning technique. Ribbons melt-spun at rates insufficient to yield an amorphous structure were observed to contain crystals having the "$L1_2$-type" structure. Foils and ribbons initially amorphous were subsequently crystallized by annealing at 360°–400° C. for several hours. These samples crystallize to a single phase "$E9_3$-type" crystalline material. Amorphous, "$L1_2$-type", and "$E9_3$-type" samples were all hydrided by exposure to pure hydrogen gas at 1 atmosphere pressure at a temperature of 180°–200° C.

The absorption of hydrogen gas was determined by measuring the hydrogen gas pressure in a vessel of known volume. All three type of samples (e.g. amorphous,"$L1_2$-type", and "$E9_3$-type") absorbed hydrogen and became saturated after several days. The final hydrogen content after saturation was found to be identical for all three types of sample and yields a hydrogen-atom/metal-atom ratio $H/M=1.4$. All three types of hydrided samples were then carefully studied by X-ray diffraction techniques and found to be amorphous. Other properties of the three types of samples (e.g. mass density, superconducting transition temperatures, electrical resistivity) were found to be identical within experimental error. We conclude that all three types of samples form a well defined amorphous hydride phase.

An attempt was made to reversibly desorb the hydrogen from the samples in order to obtain a hydrogen free amorphous byproduct. The samples were heated to 150° C. in a vacuum of $10^{-6}$–$10^{-7}$ torr. A fraction (~50%) of the hydrogen is desorbed by this treatment. The samples were subsequently again studied by X-ray diffraction. A partial crystallization of the samples was observed. The X-ray pattern shows amorphous material and a fine-grained crystalline phase $ZrH_2$ having a fcc structure. The grain size of the $ArH_2$ crystallites was estimated to be 45 Å from X-ray diffraction data. It should also be mentioned that samples initially hydrided at temperatures above 220° C. showed a similar nucleation of $ZrH_2$ crystallites.

In summary, it has been experimentally demonstrated that an entirely amorphous hydride phase can be prepared by reaction of hydrogen gas with crystalline material of the $L1_2$ or $E9_3$-type structure. FIG. 1 illustrates the growth of the amorphous hydride. At temperature below or near 180° C., hydrogen 12 penetrates the sample by diffusion. Hydrogen diffuses into crystalline material 16, but does not form a crystalline hydride. Instead, it reacts at the interface with amorphous material 14 to form an amorphous hydride $Zr_3RhH_{5.5}$. A thermodynamic driving force is provided by the lowering of the hydrogen chemical potential as it leaves the solid solution in the crystalline region 16 and enters the amorphous hydride region 14. The rate of growth of the amorphous hydride is determined by the rate of hydrogen diffusion (the diffusion current) in the sample. The growth rate can be characterized by the velocity $\nu$ of the moving interface. $J_H$ is the diffusion current of hydrogen.

Figure 2:
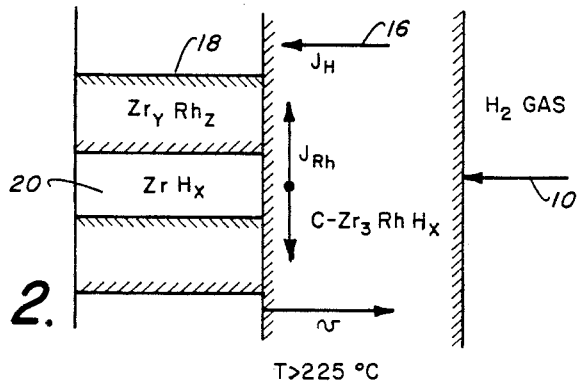
FIG. 2 is a schematic representation of the system of FIG. 1 when grown at higher temperatures in which the second component has a significant diffusion rate.

At higher temperature, a new reaction occurs which is illustrated in FIG. 2. For temperatures well above 200° C., the interdiffusion of Rh and Zr in the crystalline layer 16 becomes larger. Rh can now diffuse over distances large enough to permit a reaction to a two phase byproduct consisting of $ZrH_x$ with $x \approx 2$ (material 20) and a Rh-rich phase $Zr_yRh_z$ which may be either crystalline or amorphous (material 18). Thus the formation of amorphous hydride (FIG. 1) must be carried out at temperatures sufficiently low to avoid the Rh(Zr) interdiffusion ($J_{Rh}$) which permits the reaction of FIG. 2. These factors give temperature limits for the growth of an amorphous hydride by reaction with hydrogen gas 10.

EXAMPLE 2

Figure 3A:
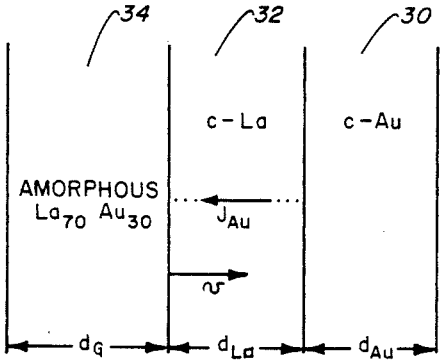
FIG. 3(*a*) is a schematic representation of the growth of amorphous material from two crystalline thin layers and an amorphous layer.
Figure 3B:
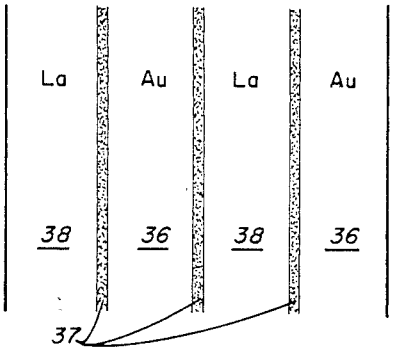

Reaction of crystalline layers to form an amorphous layer. This reaction has been performed successfully in the two configurations shown in FIGS. 3(*a*) and 3(*b*), respectively. In FIG. 3(*a*), crystalline layers 30 and 32 of two pure metals are induced to react chemically by the presence of a third thin layer 34 of an amorphous alloy of the metals in layers 30 and 32. The amorphous layer 34 provides a "nucleus" for the growth of additional amorphous alloy material from atoms of layers 30 and 32. In FIG. 3(*b*), crystalline layers 36 and 38 of two pure metals alternate forming a multilayer compact. It has been experimentally shown that when these layers are sequentially deposited from the vapor phase, a disordered interface region such as an amorphous alloy phase 37 (counterpart to layer 34 in FIG. 3(*a*)) is already present at the interface between crystalline layers 36 and 38 in a quantity sufficient to nucleate the reaction. Therefore, the amorphous "nucleus" layer need not be separately introduced.

For the purpose of demonstration, the Au (gold) is utilized to form the crystalline layer 30 and 36 and the metal La (lanthanum) is utilized to form the crystalline layer 32 and 38. The alloy $La_{70}Au_{30}$ is utilized to form the amorphous layer 34. All layers are prepared by deposition from the appropriate vapor phase in a vacuum of $10^{-7}$ torr. The amorphous $La_{70}Au_{30}$ layer has a typical thickness $d_G=100-500$ Å while the crystalline metal layers have thicknesses $d_{La} \sim d_{Au} \sim 100$–3000 Å. The structure of each layer, crystalline or amorphous, is determined by X-ray diffraction.

Figure 4:
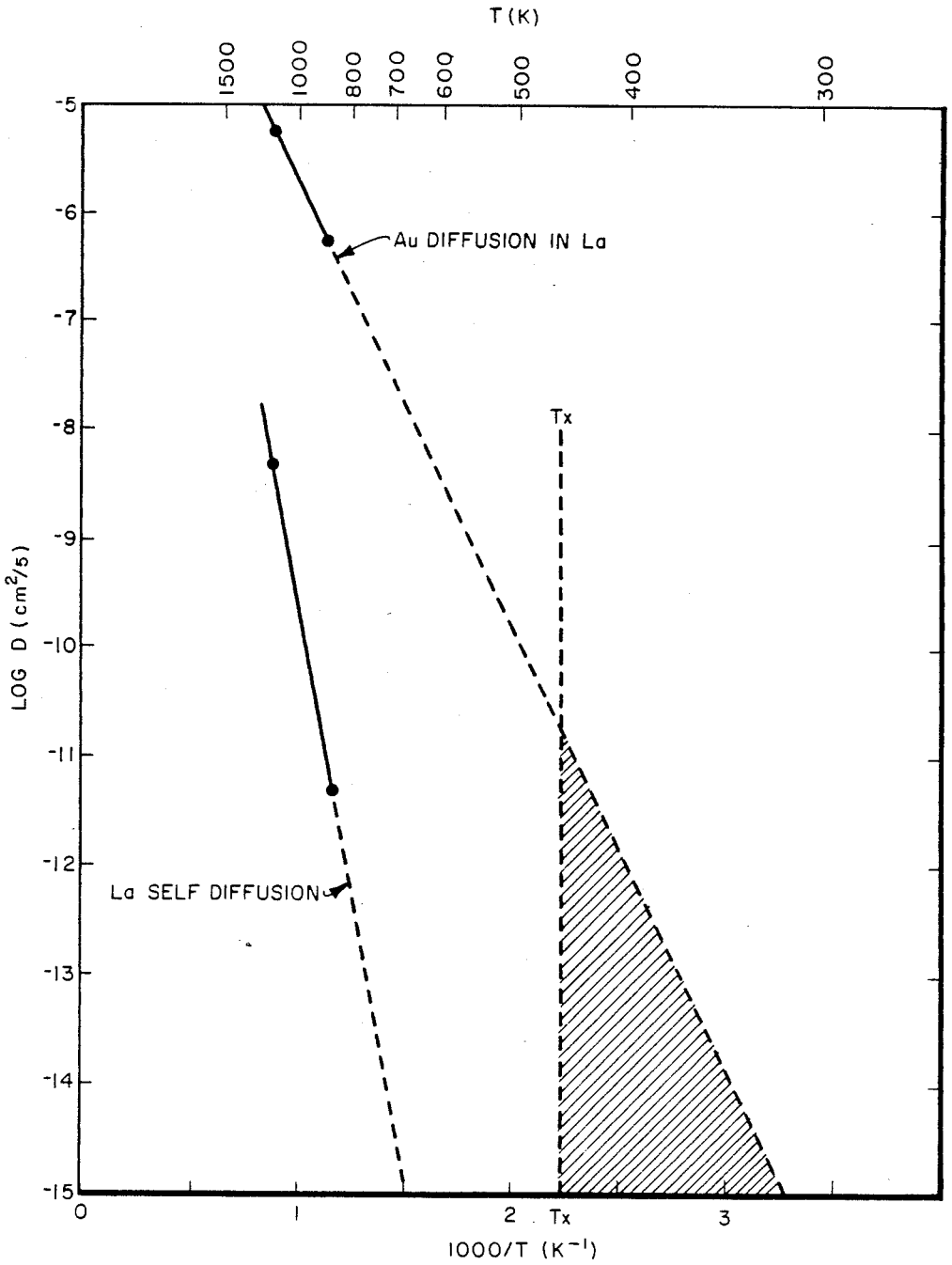
FIG. 4 is a graph showing the diffusion coefficients of the components of the system of FIGS. 3(*a*) and 3(*b*) illustrating the allowed region for the glass forming reaction.

The kinetics of the reaction is determined by the rate of diffusion of Au in La. This is illustrated in FIG. 4 where the logarithm of the diffusion constant for Au in La and for the self-diffusion constant of La are plotted as a function of reciprocal temperature. Also shown is the temperature $T_x$ at which the amorphous $La_{70}Au_{30}$ alloy is experimentally observed to crystallize. The data shown are taken from the literature. An upper bound for the temperature $T_{min}$ at which the reaction can be performed is determined by the time $\tau$ available to complete the reaction. (Condition imposed, for example, by a manufacturing process). Because Au must be transported by diffusion a distance $d_{La}$, the $T_{min}$ follows from the equation $(4D\tau)^{\frac{1}{2}}=d_{La}$, where D(T) is the diffusion constant of Au in La. These considerations define the general limitations of the amorphous growth reaction which, for the case of the Au-La reaction are shown as shaded area in FIG. 4.

Experimentally, it has been found that crystalline Au and La layers of thickness $d_{Au} \sim d_{La} \sim 100$–3000 Å react in time $\tau$ or 0.5 to 10 hours at temperatures, $T=60°-100°$ C. to form a nearly entirely amorphous byproduct.

EXAMPLE 3

Figure 5:
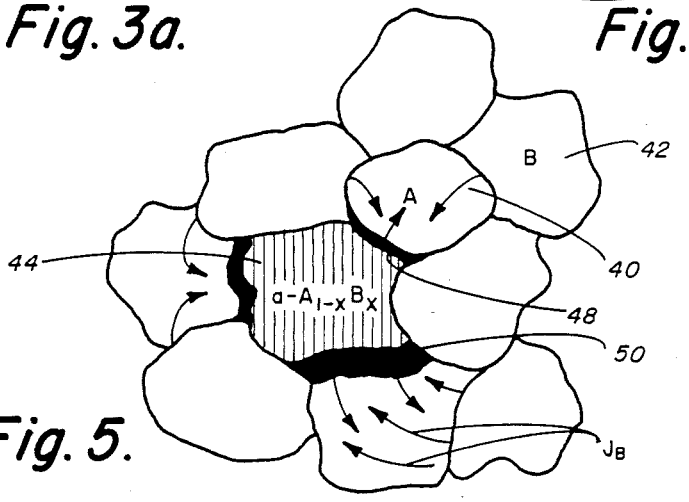
FIG. 5 is a schematic view of the method practiced on compacted powders.

Reaction of crystalline metal powders in presence of an amorphous powder or other suitable nucleation site to form an amorphous byproduct. The advantage of using powders lies in the ability to synthesize three dimensional objects of amorphous alloys of arbitrary shape as a byproduct. The experiment is illustrated below in FIG. 5.

Crystalline particles 40 of metal A, crystalline particles 42 of metal B, and amorphous particles 44 of an alloy $A_{1-x}B_x$ are compacted into a unitary structure. The particles of amorphous alloy need not be present if other nucleation sites such as grain boundaries, dislocations, or other defects act as nucleation sites. The compacted mixture of powders is heated to a temperature below the crystallization temperature $T_x$ of the amorphous $A_{1-x}B_x$ alloy. Component B diffuses into and across component A with a diffusion current $J_B$ to the interface 48 between A and the amorphous alloy to form additional amorphous material, resulting in a moving reaction interface.

In this case, metal B exhibits fast diffusion behavior in metal A at temperatures which lie below the crystallization temperature $T_x$ of amorphous $A_{1-x}B_x$. Again, a basic requirement for growth of the amorphous material is that the diffusion current $J_B$ of metal B in particles of metal A be sufficient to permit growth of the amorphous phase at temperatures below $T_x$. Again, it is seen that this occurs in a temperature range $T_{min}<T<T_x$ where $T_{min}$ is determined by requiring transport of B over distances typical of the particle size of the powder within the time available for the completion of the reaction.

This method could be used to produce bulk objects of bistable, metallic amorphous or fine crystalline materials. Since pure metal powders are ductile and may be easily compacted into various shapes, one can form an object from a mixture of pure metal powders and small amount of amorphous powder, the latter to serve as a "nucleus" for the subsequent growth of the amorphous material in the case that nucleating sites do not already exist. Then, a low temperature solid-state reaction permits the transformation of the compacted material to an amorphous metallic alloy having the same shape as the desired final product.

The method of this invention can also be used to synthesize the other crystalline metastable materials. For example, an obvious extension is to the synthesis of fine-grained polycrystalline metallic materials. When the above reactions are carried out at temperatures near or above, usually within 25° C. of the crystallization temperature $T_x$ of the $A_{1-x}B_x$ amorphous alloy, the byproduct will be a fine-grained polycrystalline material. As an example, when the hydriding reaction (Example 1) is carried out at $T>225°$ C., the byproduct was observed to be a fine-grained $ZrH_2$ phase embedded in an Rh-rich amorphous matrix. The grain size was found to be 40–50 Å. Analogously, it is expected that when reactions of metal layers or powders are carried out at temperature near or above $T_x$ (the crystallization temperature of the glassy $A_{1-x}B_x$ phase), a fine-grained crystalline material will result. Such fine-grained polycrystalline materials are also of technological interest. The method produces such material when reaction of systems, such as those given in Table 1, is carried out at temperature somewhat higher than those required for growth of the amorphous phase.

A second extension is in the synthesis of a metastable crystalline alloy $A_xB_y$ by fast diffusion of metal B in host metal A. In this case, the previous "seed" material (e.g., the amorphous particles in Example 3) is replaced by a metastable crystalline $A_xB_y$ "seed" material. The reaction again proceeds by fast diffusion of B atoms in the A particles resulting in a growth of the $A_xB_y$ compound at the interface between the A and $A_xB_y$ phases.

Amorphous material can be synthesized by the diffusion process of the invention having a grain size below 100 Å, preferably before 50 Å and a thickness exceeding 100 microns, preferably exceeding 500 microns.

It is to be realised that only preferred embodiments of the invention have been described and that numerous substitutions, modifications and alterations are permissible without departing from the spirit and scope of the invention as defined in the following claims.

We claim:

1. A method of forming metastable solid, amorphous materials comprising the steps of:

contacting a solid material with a second substance;

heating the substance and the solid material to a temperature above the temperature at which the diffusion rate of the substance into the solid material to react with a component of solid material to form a metastable solid material is at least $10^4$ times the rate of self-diffusion of a component of the solid material; and reacting the substance and the solid material at a temperature no more than 25° C. above the glass crystallization temperature of the metastable, solid amorphous material for a time sufficient for the substance to diffuse a predetermined distance through the solid material to form said metastable solid, amorphous material.

2. A method according to claim 1 in which the solid material is a solid and the substance is a gas.

3. A method according to claim 1 in which the solid material and substance are solids.

4. A method according to claim 3 in which the solid material and substance are in granular form.

5. A method according to claim 3 in which the solid material and substance are adjacent layers on the surface of a substrate.

6. A method according to claim 1 in which temperature is below the crystallization temperature of the metastable, amorphous material.

7. A method according to claim 6 in which the metastable, amorphous, solid material that forms contains grains of a fine, crystalline material having crystals no larger than 100 Å embedded in a matrix of said metastable, amorphous solid material and the temperature is near or above the crystallization temperature of said fine crystalline material.

8.

A method according to claim 6 further including providing a seed of said amorphous solid material in contact with the solid material and substance during said reaction.

9. A method according to claim 8 in which the seed is in granular form and is in contact with the substance and solid material which are in a granular form.

10. A method according to claim 8 in which the seed is a substrate on which is coated layers of the solid material and substance.

11. A method according to claim 1 in which the reaction is continued for 0.5 hour to 30 days.

12. A method according to claim 11 in which the metastable solid material is a metastable amorphous alloy of the formula $A_{1-x_o}B_{x_o}$ where $x_o$ is a fractional number, the diffusion rate of B in A is at least $10^4$ times the self-diffusion rate of A and B diffuses in A over distances of the order of 1 μm or more in practical time periods.

13. A method according to claim 12 in which A is selected from Groups IIB, IVB or VB and B is selected from Groups VIIB, VIII or IB of the Periodic Table of Elements.

14. A method according to claim 12 in which the metastable solid is a compound of a transition metal with a mettaloid.

* * * * *

UNITED STATES PATENT AND TRADEMARK OFFICE

CERTIFICATE OF CORRECTION

PATENT NO. : 4,564,396

DATED : January 14, 1986

INVENTOR(S) : William L. Johnson, et al

It is certified that error appears in the above-identified patent and that said Letters Patent are hereby corrected as shown below:

Page 1, under [75], add --Konrad Samwer, Gottingen, West Germany--

Column, line 6, Claim 14, correct "metalloid"

Signed and Sealed this

*Third* Day of *June 1986*

[SEAL]

*Attest:*

DONALD J. QUIGG

*Attesting Officer*

*Commissioner of Patents and Trademarks*